US011269276B2

(12) United States Patent
Muramatsu et al.

(10) Patent No.: US 11,269,276 B2
(45) Date of Patent: Mar. 8, 2022

(54) FIXING APPARATUS AND IMAGE FORMING APPARATUS

(71) Applicant: CANON KABUSHIKI KAISHA, Tokyo (JP)

(72) Inventors: Motoyasu Muramatsu, Susono (JP); Satoshi Murasaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/914,770

(22) Filed: Jun. 29, 2020

(65) Prior Publication Data

US 2021/0018866 A1 Jan. 21, 2021

(30) Foreign Application Priority Data

Jul. 18, 2019 (JP) ..... JP2019-132608

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2053; G03G 2215/2038; G03G 15/2064; G03G 15/6573; G03G 15/2028
See application file for complete search history.

(56) References Cited

U.S. PATENT DOCUMENTS 10,289,038 B2 5/2019 Murasaki
10,838,327 B2 11/2020 Yasui
2017/0205743 A1* 7/2017 Kamiya ..... G03G 15/2064
2018/0113405 A1 4/2018 Yasui
2018/0267444 A1* 9/2018 Kanou ..... G03G 15/2028
2019/0146386 A1* 5/2019 Tanaka ..... G03G 15/2053 399/68
2019/0235425 A1* 8/2019 Sato ..... G03G 15/2053
2020/0201220 A1* 6/2020 Sakai ..... G03G 15/2042
2020/0241457 A1* 7/2020 Eiki ..... G03G 21/1685

FOREIGN PATENT DOCUMENTS

JP 2014-228584 A 12/2014
JP 2015-111218 A 6/2015
JP 2016-66107 A 4/2016
JP 2018-66900 A 4/2018

* cited by examiner

*Primary Examiner* — Sevan A Aydin
(74) *Attorney, Agent, or Firm* — Venable LLP

(57) ABSTRACT

A fixing apparatus includes a flexible rotary member, a pressure roller, a heating element, a regulation member configured to regulate movement of the flexible rotary member by abutting against one end portion of the flexible rotary member in the axial direction, a guide unit, and an interlocking portion. The interlocking portion includes a hole portion and a shaft portion engages with the hole portion, and wherein an axis of the shaft portion is parallel to the axial direction of the flexible rotary member. The interlocking portion configured to move the guide unit in the conveyance direction in accordance with movement of the regulation member in the conveyance direction so that a clearance is kept between the guide unit and the flexible rotary member in the conveyance direction.

11 Claims, 18 Drawing Sheets

FIXING APPARATUS AND IMAGE FORMING APPARATUS

BACKGROUND OF THE INVENTION

Field of the Invention

The present invention relates to a fixing apparatus for fixing an image on a sheet and an image forming apparatus.

Description of the Related Art

A known image forming apparatus that uses an electrophotographic process and forms an image on a sheet includes a film-type fixing apparatus. The film-type fixing apparatus fixes a toner image to a sheet by using a cylindrical film. In the film-type fixing apparatus, however, there is a case in which a sheet winds around the film and causes a sheet jam. For preventing the sheet from winding around the film, Japanese Patent Application Publication No. 2014-228584 discloses a configuration that includes a separation member. The separation member is disposed downstream from a fixing nip between the film and a pressure roller in a sheet conveyance direction and positioned in the vicinity of a portion of the film that has a less curvature radius. In Japanese Patent Application Publication No. 2014-228584, the separation member is engaged with a supporting member that supports the film, and thereby the separation member is held such that a leading edge of the separation member is positioned close to the film.

In recent years, such a film is required to have a long life. Japanese Patent Application Publication No. 2016-66107 discloses a configuration that includes a correction mechanism to correct a positional displacement of a film for suppressing the wear of an end portion of the film. In Japanese Patent Application Publication No. 2016-66107, for suppressing the wear of the end portion of the film, the positional displacement of the film is corrected by moving the whole of the film upstream in the conveyance direction.

In Japanese Patent Application Publication No. 2014-228584, although the position of the separation member relative to the supporting member can be kept, the position of the separation member relative to the film may change if the position of the film supported by the supporting member changes. In Japanese Patent Application Publication No. 2016-66107, the separation member is not intended to operate even when the film is being moved in a process where a displacement of the axis of the film from the axis of the pressure roller is corrected. That is, also in Japanese Patent Application Publication No. 2016-66107, the position of the separation member relative to the film may change. The change in position of the separation member relative to the film may cause the separation member to slide on the film, causing failure in conveyance of sheets in the fixing apparatus.

The present invention has been made for solving the above-described problem, and aims to suppress the failure in conveyance in the fixing apparatus.

SUMMARY OF THE INVENTION

According to one aspect of the present invention, a fixing apparatus includes a flexible rotary member having a cylindrical shape and that rotate in a state where an outer circumferential surface of the flexible rotary member is in contact with a sheet on which a toner image is formed, a pressure roller that form a nip portion together with the flexible rotary member, the toner image being fixed to the sheet in the nip portion, a heating element that heat the nip portion, a regulation member that support the flexible rotary member is rotatable and movable with respect to the regulation member in an axial direction of the flexible rotary member, and regulate movement of the flexible rotary member by abutting against one end portion of the flexible rotary member in the axial direction, a guide unit disposed downstream from the nip portion in a conveyance direction of the sheet and that guide the sheet that has passed through the nip portion, and an interlocking portion that move the guide unit in the conveyance direction in accordance with movement of the regulation member in the conveyance direction so that a clearance is kept between the guide unit and the flexible rotary member in the conveyance direction. The interlocking portion includes a hole portion and a shaft portion engages with the hole portion. An axis of the shaft portion is parallel to the axial direction of the flexible rotary member.

Further features of the present invention will become apparent from the following description of exemplary embodiments with reference to the attached drawings.

DESCRIPTION OF THE EMBODIMENTS

Hereinafter, some embodiments of the present disclosure will be described with reference to the accompanying drawings. In the present disclosure, the description will be made for an image forming apparatus including a fixing apparatus, for example. The fixing apparatus fixes a toner image having been transferred onto a sheet, to the sheet. Note that in the embodiments of the present disclosure, an identical component is given an identical symbol and duplicated description thereof will be omitted.

First Embodiment

Configuration of Fixing Apparatus

Figure 1:
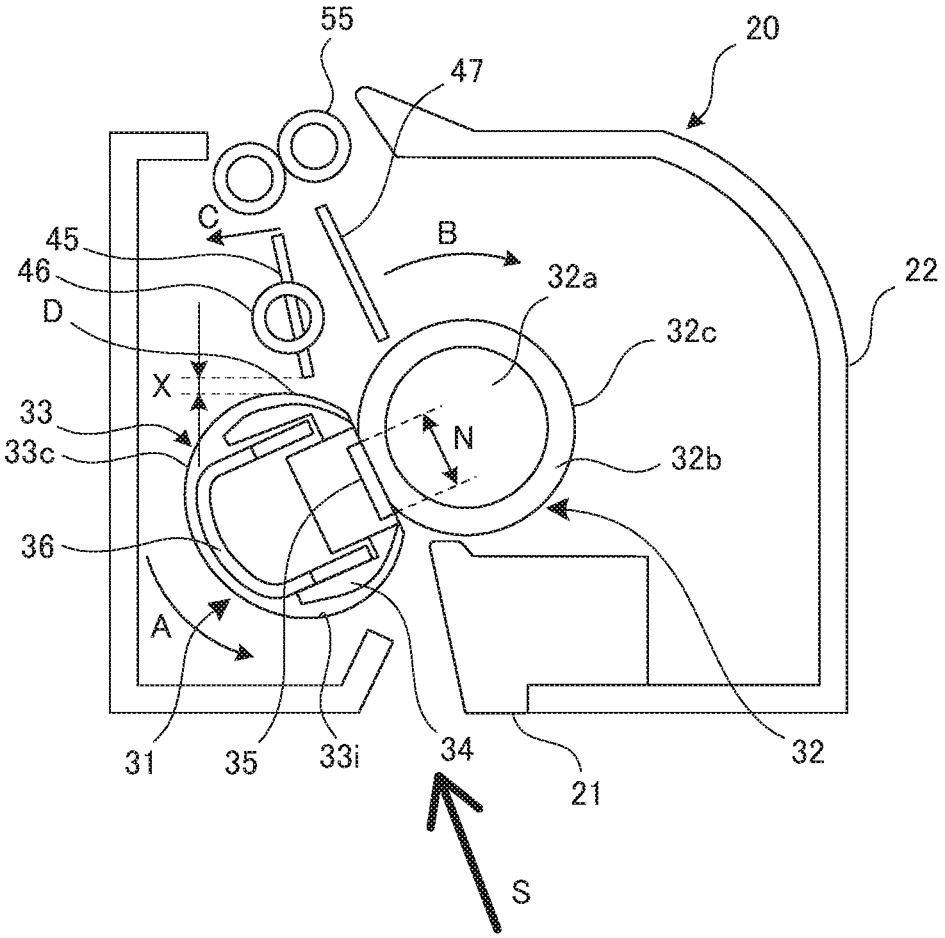
FIG. 1 is a schematic configuration diagram of a fixing apparatus of a first embodiment.

First, a schematic configuration of a fixing apparatus 20 of a first embodiment will be described. FIG. 1 is a schematic cross-sectional view of the fixing apparatus 20 of the present embodiment. FIG. 1 illustrates a cross section of the fixing apparatus 20, orthogonal to an axial direction of a fixing film 33. As illustrated in FIG. 1, the fixing apparatus 20 includes a film assembly 31, a pressure roller 32, a conveyance roller 55, a sheet conveyance guide portion 21, and an exterior portion 22. The film assembly 31 and the pressure roller 32 are in pressure contact with each other, and thereby form a nip portion N.

The film assembly 31 includes a fixing film 33, a film guide 34, a heater 35, and a pressure stay 36. The fixing film 33 of the present embodiment serves as a flexible rotary member, and is a cylindrical (endless-belt-shaped or sleeve-shaped) member with flexibility. The fixing film 33 rotates in contact with a sheet. The film guide 34 is a tub-shaped member with thermal resistance and rigidity. A cross section of the film guide 34 orthogonal to the axial direction is almost semicircular. The film guide 34 serves as a member that holds the heater 35, and as a film guide member. The heater 35 is a heating element for heating the nip portion N, and is fixed to a recess groove portion of an outer circumferential surface of the film guide 34. The groove portion is formed along an axial direction of the fixing film 33. The fixing film 33 is disposed outside the film guide 34 (to which the heater 35 is attached) such that the fixing film 33 can rotate in a state where a clearance is kept between the fixing film 33 and the film guide 34. The pressure stay 36 is a member with rigidity. A cross section of the pressure stay 36 orthogonal to the axial direction is U-shaped. The pressure stay 36 is disposed inside the film guide 34.

Figure 2:
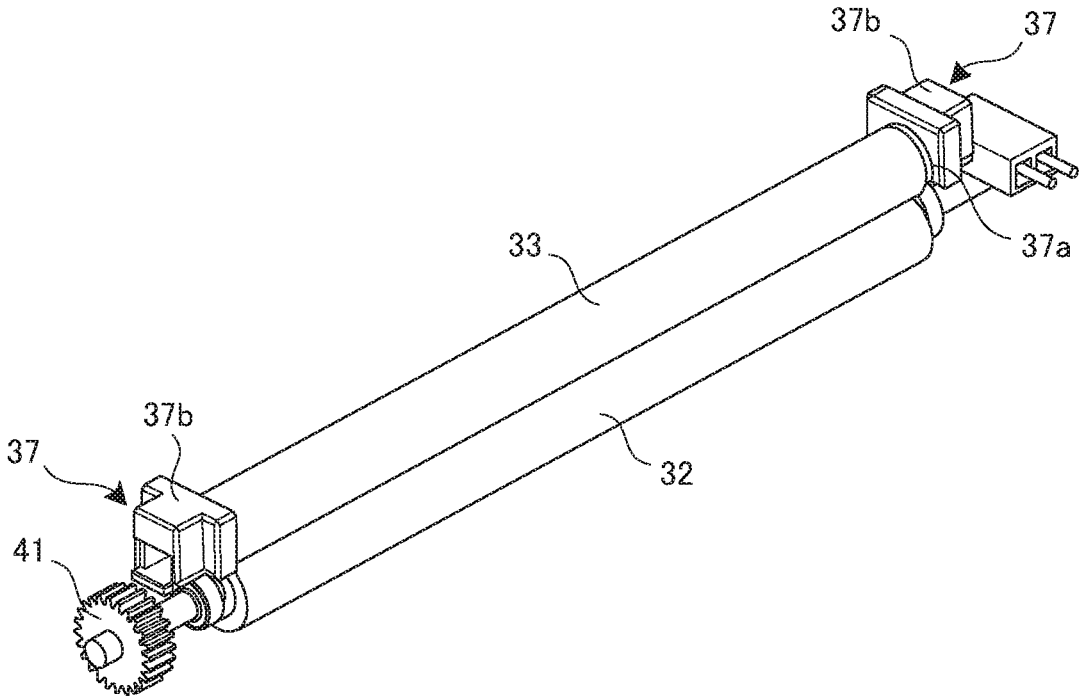
FIG. 2 is a perspective view illustrating a fixing film and a pressure roller of the first embodiment.

FIG. 2 is a perspective view illustrating the fixing film 33 and the pressure roller 32 of the present embodiment. As illustrated in FIG. 2, a film holder 37 is disposed so as to face one end portion of the fixing film 33 in the axial direction of the fixing film 33. The film holder 37 includes a regulation member 37*a* and a supporting member 37*b*. The regulation member 37*a* regulates movement of the fixing film 33 in the axial direction, and the supporting member 37*b* supports the regulation member 37*a*. The fixing film 33 is a heat-resistant resin belt or a composite layer structure. The composite layer structure includes a base layer and an elastic layer or release layer. The base layer is a heat-resistant resin belt or a metal belt, and the elastic layer or release layer is formed on an outer circumferential surface of the base layer. The fixing film 33 is thin as a whole; and has flexibility, high thermal conductivity, and low thermal capacity. In the present embodiment, the regulation member 37*a* regulates the movement of the fixing film 33 in the axial direction, and also regulates trajectory of rotation of one end portion of the fixing film 33. That is, the trajectory of rotation of the fixing film 33 is regulated by the film holder 37.

The heater 35 is a long-and-thin linear heating element with low thermal capacity, and is disposed to heat the whole of a longitudinal portion of the fixing film 33 in the axial direction of the fixing film 33. The heater 35 includes a heater substrate and a current-carrying heating layer formed on the heater substrate. The heater substrate is made of a ceramic material such as aluminum nitride or alumina, and the current-carrying heating layer is made of a silver-palladium alloy, for example Note that a known ceramic heater may be used as the heater 35. The pressure roller 32 is a member with predetermined hardness, and includes a core metal 32*a* and an elastic layer 32*b* formed on an outer circumferential surface of the core metal 32*a*. The elastic layer 32*b* is made of silicone rubber, for example Note that a fluororesin layer 32*c*, made of PTFE (Polytetrafluoroethylene), PFA (Perfluoroalkoxy Alkane), FEP (Perfluoro-Ethylene Propene copolymer), or the like, may be formed on an outer circumferential surface of the elastic layer 32*b* for increasing non-adhesive property of the pressure roller 32. As illustrated in FIG. 2, the pressure roller 32 is rotated by driving a driving gear 41 disposed on one end portion of the pressure roller 32 in the axial direction, and the fixing film 33 is rotated by the rotation of the pressure roller 32.

Figure 3:
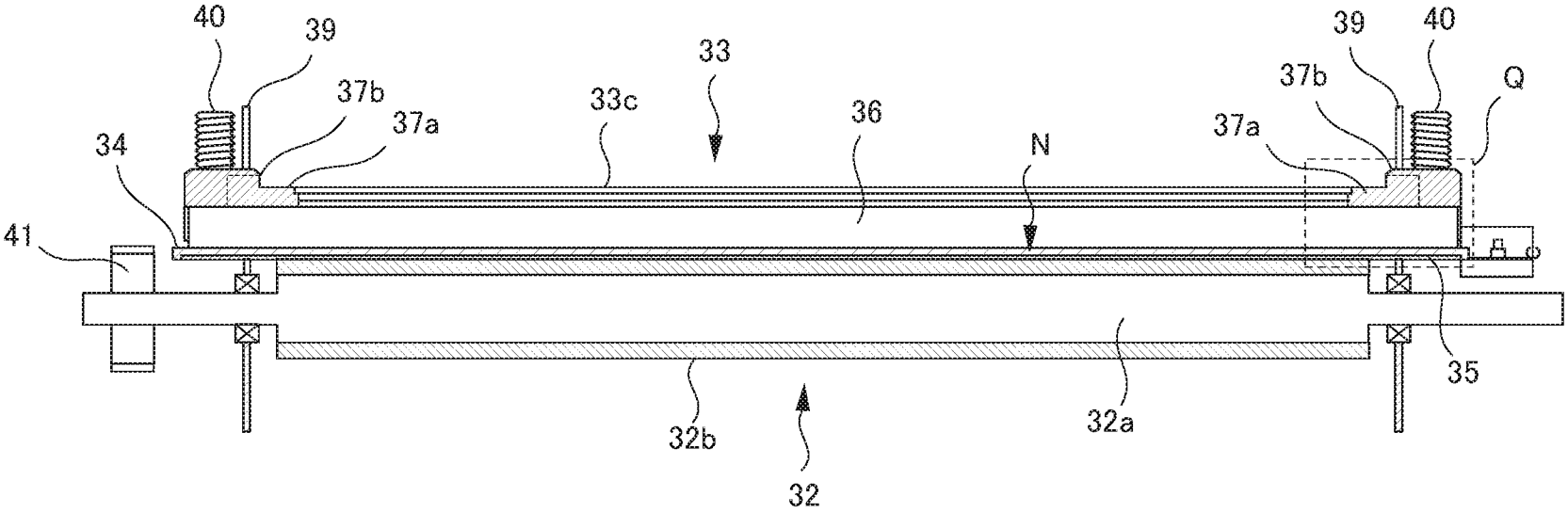
FIG. 3 is a sectional view illustrating the fixing film and the pressure roller of the first embodiment.

FIG. 3 illustrates the fixing film 33 and the pressure roller 32 viewed from a sheet conveyance direction. In the film assembly 31, the film guide 34, the heater 35, and the pressure stay 36 are disposed in the internal space of the fixing film 33 (see FIG. 1). As illustrated in FIG. 3, the supporting member 37*b* is urged toward the pressure roller 32 by a pressure spring 40, and thereby the fixing film 33 is in contact with the pressure roller 32. In addition, since the fixing film 33 is pressed against the pressure roller 32 by the pressure spring 40 via the pressure stay 36, the film guide 34, and the heater 35, the nip portion N in which a toner image is fixed to a sheet is formed. As illustrated in FIG. 3, the supporting member 37*b* is supported by a fixing side plate 39.

The sheet closely contacts the fixing film 33, and passes through the nip portion N while overlapping with the fixing film 33. Specifically, the sheet is conveyed and passes through the nip portion N while nipped in the nip portion N. When the sheet passes through the nip portion N, heat energy is applied from the heater 35 to the toner image (borne by the sheet and still not fixed to the sheet) via the fixing film 33. The toner image, still not fixed to the sheet, is heated and melted by the heat energy and fixed to the sheet. The sheet having passed through the nip portion N is separated from an outer circumferential surface 33*c* of the fixing film 33, due to stiffness of the sheet itself and by a guide unit 45 (see FIG. 1). Then the sheet is guided toward a direction in which the conveyance roller 55 conveys the sheet, by the guide unit 45, a conveyance guide 47, and a roller 46. The conveyance guide 47 is disposed so as to face the guide unit 45 via the sheet conveyance path, and the roller 46 is disposed in the guide unit 45. The sheet is then conveyed to a discharging portion 13 (see FIG. 16) disposed downstream from the fixing apparatus 20 in the sheet conveyance direction, and is discharged to the outside of the image forming apparatus 100 by the discharging portion 13.

Configuration of Image Forming Apparatus

Figure 16:
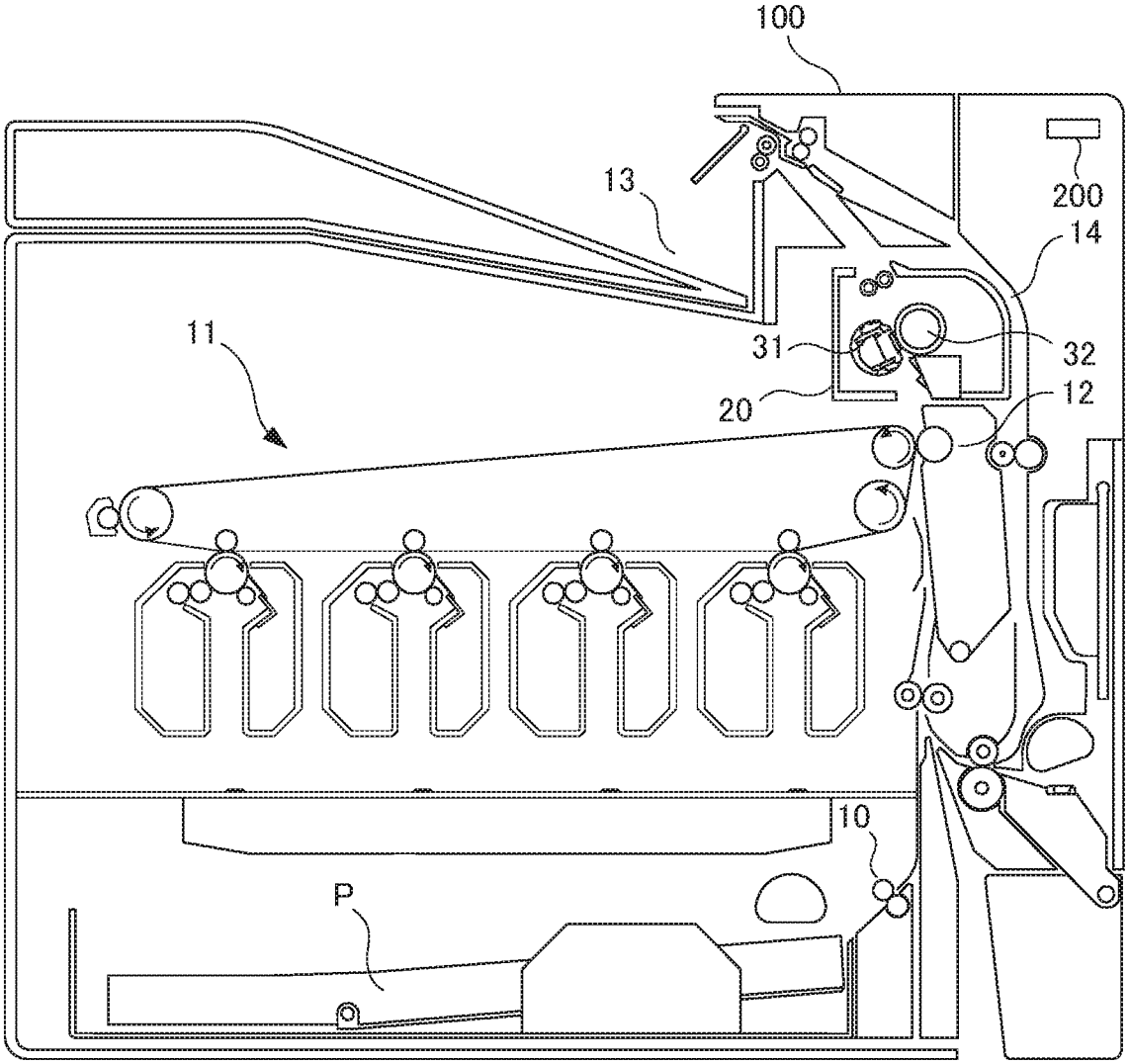
FIG. 16 is a schematic configuration diagram of an image forming apparatus of the first embodiment.

Next, the image forming apparatus 100 including the fixing apparatus 20 will be described with reference to FIG. 16. FIG. 16 is a schematic configuration diagram of the image forming apparatus 100 of the present embodiment. Like FIG. 1, FIG. 16 illustrates a cross section of the image forming apparatus 100, orthogonal to the axial direction of the fixing film 33. The image forming apparatus 100 including A control unit 200 controls operations of components of the fixing apparatus 20. A sheet P fed from a feeding portion 10 is conveyed to an image forming portion 11. The image forming portion 11 of the present embodiment includes an electrophotographic image forming mechanism. Then, a toner image is transferred by a transfer portion 12, onto the sheet P that has been conveyed to the image forming portion 11. The toner image is fixed to the sheet P when the sheet P passes through the fixing apparatus 20. The sheet P having passed through the fixing apparatus 20 is discharged to the discharging portion 13. When duplex printing is performed on the sheet P, the image forming apparatus 100 causes the sheet P having passed through the fixing apparatus 20 to switchback, and conveys the sheet P to the image forming portion 11 again through a duplex conveyance path 14. Then another toner image is transferred onto a back side of the sheet P in the transfer portion 12, and the toner image is fixed to the sheet P in the fixing apparatus 20. After passing through the fixing apparatus 20, the sheet P is discharged to the outside of the image forming apparatus 100 by the discharging portion 13.

Configuration of Correction Mechanism

Figure 4:
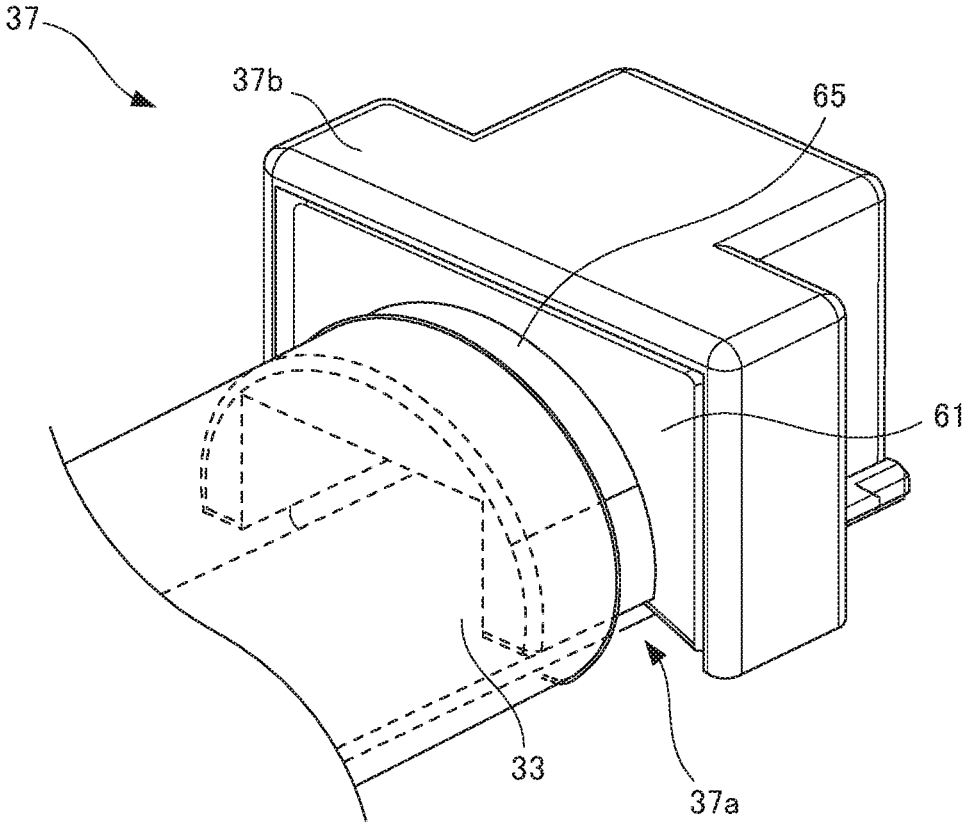
FIG. 4 is a perspective view of a film holder of the first embodiment.
Figure 5:
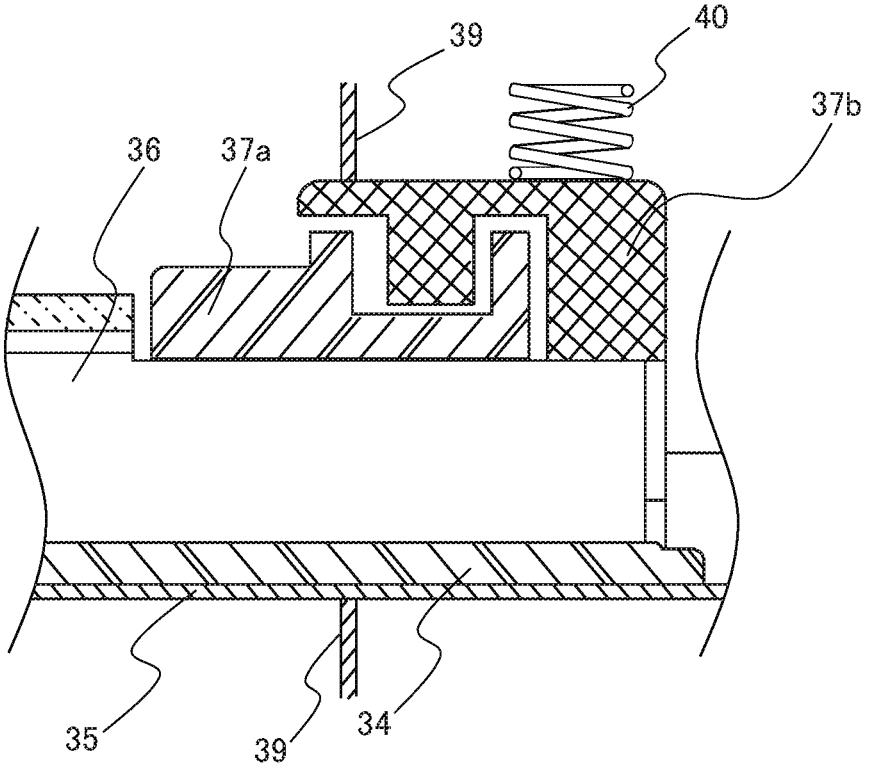
FIG. 5 is a sectional view of the film holder of the first embodiment.
Figure 6:
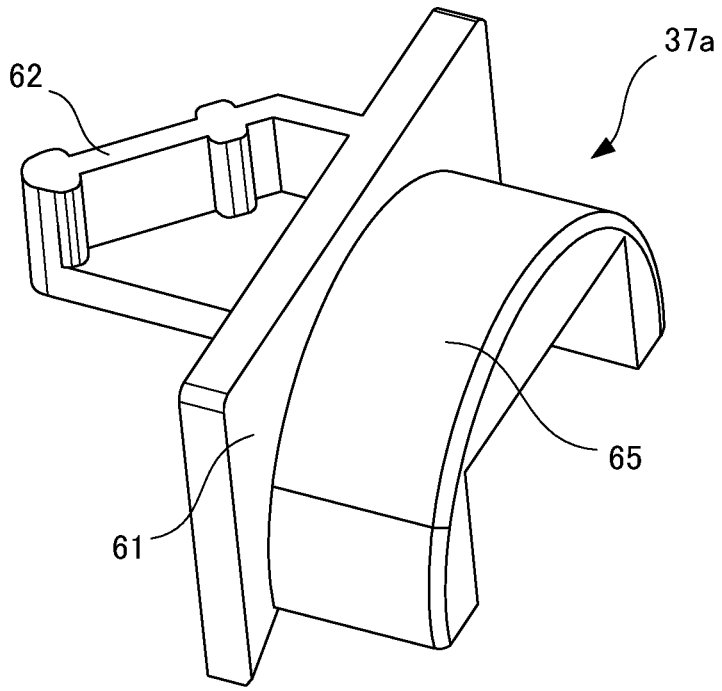
FIG. 6 is a perspective view of a regulation member of the first embodiment.
Figure 7:
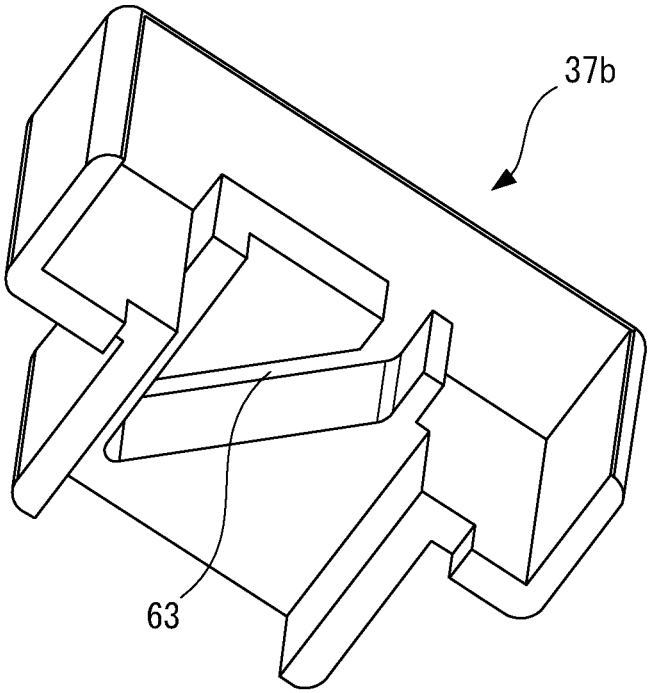
FIG. 7 is a perspective view of a supporting member of the first embodiment.
Figure 8:
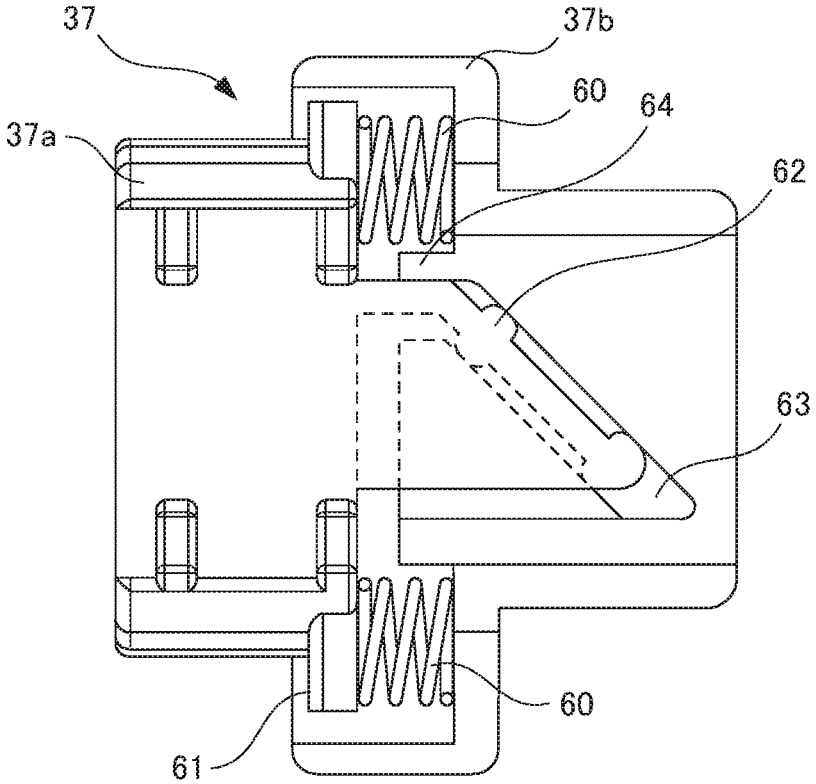
FIG. 8 is an internal configuration diagram of the film holder of the first embodiment.

Next, a configuration of the film holder 37 will be described with reference to FIGS. 4 to 8. FIG. 4 is a perspective view of the film holder 37. FIG. 5 is a diagram in which a broken-line area Q of FIG. 3 is enlarged. Specifically, FIG. 5 is a sectional view of the film holder 37 viewed from a direction orthogonal to the sheet conveyance direction and the axial direction of the fixing film 33. FIG. 6 is a perspective view of the regulation member 37*a*. FIG. 7 is a perspective view of the supporting member 37*b*. FIG. 8 is an internal configuration diagram of the film holder 37 viewed from the pressure roller 32 side in a state where the fixing film 33 is in contact with the pressure roller 32.

As illustrated in FIG. 4, the film holder 37 includes the regulation member 37*a* and the supporting member 37*b*. The supporting member 37*b* supports the regulation member 37*a* in a state where the supporting member 37*b* accommodates one portion of the regulation member 37*a* in the axial direction of the fixing film 33. In addition, as illustrated in FIG. 8, the film holder 37 also includes an urging member 60 between the regulation member 37*a* and the supporting member 37*b*, which accommodates one portion of the regulation member 37*a* in the axial direction of the fixing film 33. The urging member 60 is an elastic member, such as a spring, that elastically deforms between the regulation member 37*a* and the supporting member 37*b* (which accommodates one portion of the regulation member 37*a* in the axial direction of the fixing film 33) in the axial direction of the fixing film 33, and that urges the regulation member 37*a* in a first direction extending from an end portion of the fixing film 33 toward a center portion of the fixing film 33. As illustrated in FIG. 5, the position of the supporting member 37*b* in the axial direction of the fixing film 33 and in the sheet conveyance direction is positioned by the fixing side plate 39. The urging force of the pressure spring 40 is transmitted to the film guide 34 and the heater 35 via the pressure stay 36. The regulation member 37*a* is disposed at each of the right end portion and the left end portion of the fixing film 33 in the axial direction, such that the regulation member 37*a* is in contact with the pressure stay 36. In addition, the regulation member 37*a* is disposed such that a slight clearance is kept between the regulation member 37*a* and the supporting member 37*b*. With this arrangement, the regulation member 37*a* is positioned in a direction in which the regulation member 37*a* is pressed by the pressure stay 36.

As illustrated in FIG. 4, the regulation member 37*a* includes an end-portion abutment surface 61 and an inner-portion abutment surface 65. The end-portion abutment surface 61 can abut against one end portion of the fixing film 33, and regulates the movement of the fixing film 33 in the axial direction. The inner-portion abutment surface 65 can slide on an inner circumferential surface 33*i* of the fixing film 33 (see FIG. 1). In addition, as illustrated in FIG. 6, the regulation member 37*a* includes a convex portion 62. The convex portion 62 is formed opposite to the inner-portion abutment surface 65 with respect to the end-portion abutment surface 61, and is oblique with respect to the axial direction of the fixing film 33 and the sheet conveyance direction. As illustrated in FIG. 7, the supporting member 37*b* includes a concave portion 63 that is oblique with respect to the axial direction of the fixing film 33 and the sheet conveyance direction. As illustrated in FIG. 8, the film holder 37 is formed such that the convex portion 62 is accommodated in the concave portion 63. Thus, when the urging member 60 is elastically deformed by the movement of the fixing film 33 in the axial direction, the regulation member 37*a* moves while the convex portion 62 slides on the concave portion 63. When the convex portion 62 slides on the concave portion 63, the regulation member 37*a* is guided toward a direction that is oblique with respect to the axial direction of the fixing film 33 and the sheet conveyance direction. That is, when the convex portion 62 and the concave portion 63, which serve as a guide portion of the present embodiment, slide on each other, the moving direction of the regulation member 37*a* changes from the direction along the axial direction of the fixing film 33 to the direction oblique with respect to the axial direction of the fixing film 33 and the sheet conveyance direction. Thus, the regulation member 37*a* can move with respect to the supporting member 37*b*, in the direction oblique with respect to the axial direction of the fixing film 33 and the sheet conveyance direction.

Figure 9A:
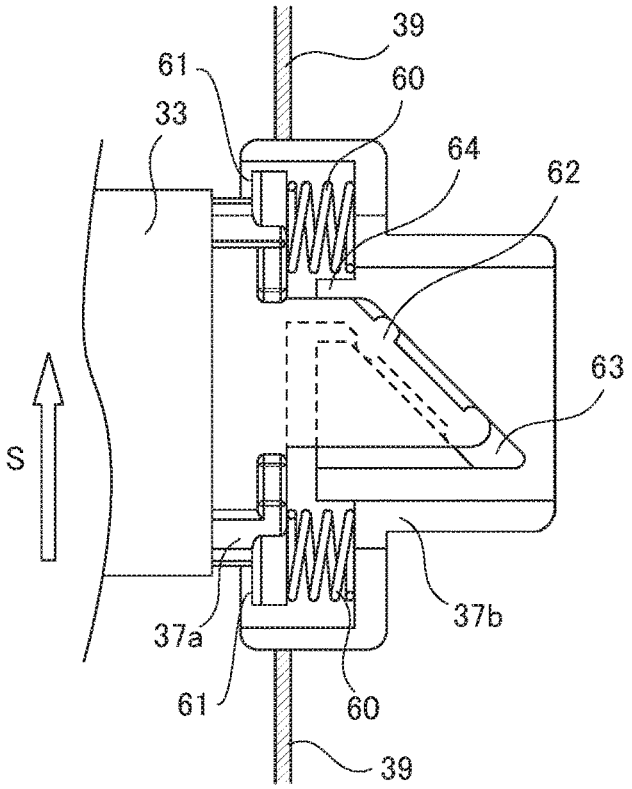
FIG. 9A is a diagram illustrating an operation of the regulation member in a state where the fixing film of the first embodiment is not in contact with an end-portion abutment surface.
Figure 9B:
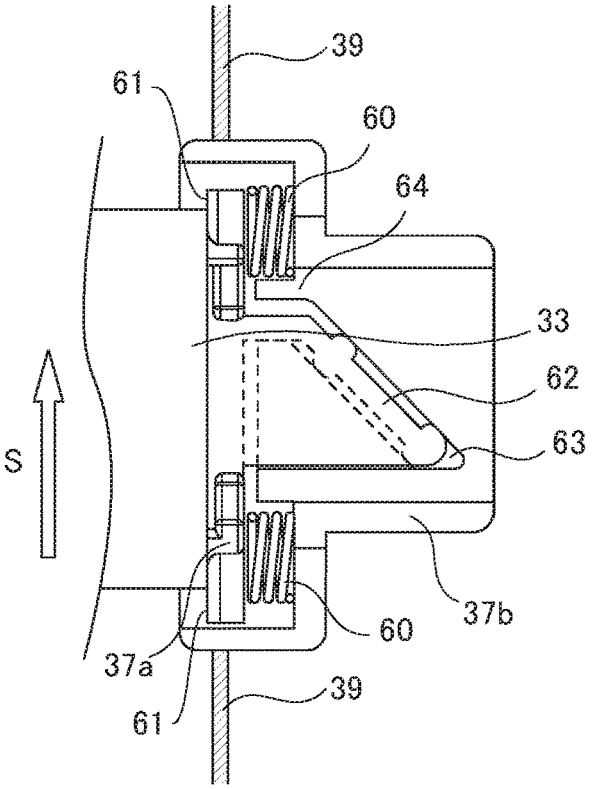
FIG. 9B is a diagram illustrating an operation of the regulation member in a state where the fixing film of the first embodiment is in contact with the end-portion abutment surface.

Next, a movement of the fixing film 33 in the film holder 37 will be described with reference to FIGS. 9A and 9B. FIGS. 9A and 9B are diagrams illustrating a movement of the regulation member 37*a*. FIG. 9A is a diagram of the film holder 37, obtained when the fixing film 33 is viewed from the pressure roller 32 side in a state where the fixing film 33 and the pressure roller 32 form the nip portion N. First, the movement of the regulation member 37*a* will be described. FIG. 9A illustrates a state where one end portion of the fixing film 33 in the axial direction is not in contact with the end-portion abutment surface 61. By the way, the regulation member 37*a* is urged by the urging member 60 toward a direction extending from the one end portion of the fixing film 33 toward a center portion of the fixing film 33. Hereinafter, for convenience of description, the direction extending from the one end portion of the fixing film 33 toward the center portion of the fixing film 33 is defined as a first direction. The supporting member 37*b* includes a stopper portion 64. Thus, when the regulation member 37*a* abuts against the stopper portion 64, the position of the regulation member 37*a* is fixed in the axial direction of the fixing film 33. If the one end portion of the fixing film 33 abuts against the end-portion abutment surface 61 in the state of FIG. 9A, a force is applied to the regulation member 37*a* toward a direction extending from the center portion of the fixing film 33 to the one end portion of the fixing film 33 in the axial direction. FIG. 9B illustrates a state where the regulation member 37*a* is pressed by the force.

The position of the fixing film 33 relative to the pressure roller 32 may change from a suitable position positioned for fixing a toner image to a sheet. For example, if the axis of the pressure roller 32 crosses the axis of the fixing film 33, the position of the fixing film 33 relative to the pressure roller 32 changes from the suitable position positioned for fixing a toner image to a sheet. Hereinafter, the change in position of the fixing film 33 relative to the pressure roller 32 from the suitable position (of the fixing film 33 relative to the pressure roller 32) positioned for fixing a toner image to a sheet is referred to as misalignment. The misalignment is caused by deterioration of the pressure roller 32 or the fixing film 33, for example. If the fixing film 33 is rotated in a misalignment state, the fixing film 33 starts to move toward the regulation member 37*a*. Then one end portion of the fixing film 33 abuts against the end-portion abutment surface 61, and the regulation member 37*a* is pressed by the fixing film 33. If a force larger than the urging force of the urging member 60 is applied to the end-portion abutment surface 61 by the fixing film 33, the regulation member 37*a* starts to move in a direction opposite to the first direction, that is, in a second direction extending from the center portion of the fixing film 33 toward the one end portion of the fixing film 33. If a force even larger than the urging force of the urging member 60 is applied to the end-portion abutment surface 61 by the fixing film 33, the regulation member 37*a* further moves in the second direction. As a result, the concave portion 63 and the convex portion 62 (see FIGS. 6 and 7) slide on each other, and the regulation member 37*a* moves toward a direction oblique with respect to the axial direction of the fixing film 33 and a sheet conveyance direction S. Consequently, the regulation member 37*a* moves from a position illustrated in FIG. 9A to a position illustrated in FIG. 9B, that is, moves upstream in the sheet conveyance direction S.

As described above, the trajectory of rotation of the fixing film 33 is regulated by the regulation member 37*a*. Thus, when the regulation member 37*a* moves, the fixing film 33 is applied with a force that moves the fixing film 33 upstream in the sheet conveyance direction S. If the one end portion of the fixing film 33 is separated from the regulation member 37*a*, the regulation member 37*a* is moved from the position illustrated in FIG. 9B back to the position illustrated in FIG. 9A, that is, moves downstream side in the sheet conveyance direction S, by the urging force of the urging member 60. After the regulation member 37*a* moves from the position illustrated in FIG. 9B back to the position illustrated in FIG. 9A, the position of the fixing film 33 changed downstream side in the sheet conveyance direction S. In the present embodiment, the position of the fixing film 33 is changed by the regulation member 37*a*, which moves in this manner.

However, if the one end portion of the fixing film 33 is not separated from the regulation member 37*a*, and the fixing film 33 continues rotating in a misalignment state, the regulation member 37*a* remains located at the position illustrated in FIG. 9B. If the fixing film 33 continues rotating at the position illustrated in FIG. 9B, the fixing film 33 continuously slides on the regulation member 37*a* and the one end portion of the fixing film 33 wears off. For this reason, it is necessary to correct the misalignment for separating the one end portion of the fixing film 33 from the regulation member 37*a*. In the present embodiment, the wear of the fixing film 33 is suppressed by correcting the movement of the fixing film 33, which occurs in the axial direction and is caused by the misalignment.

Position Correction Mechanism for Fixing Film

Figure 10A:
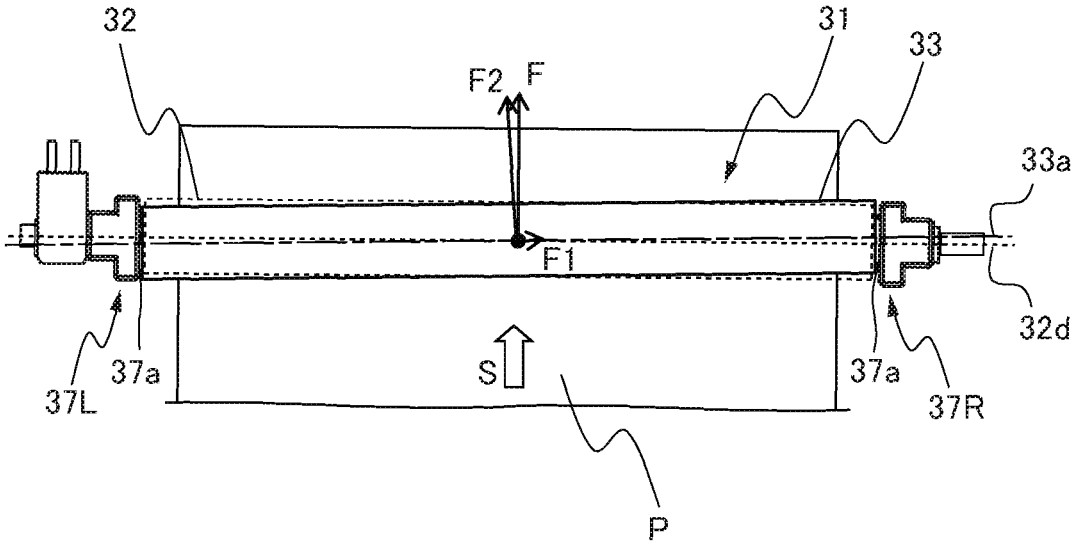
FIG. 10A is a diagram illustrating a position correction mechanism for the fixing film of the first embodiment and illustrating a misalignment state.
Figure 10B:
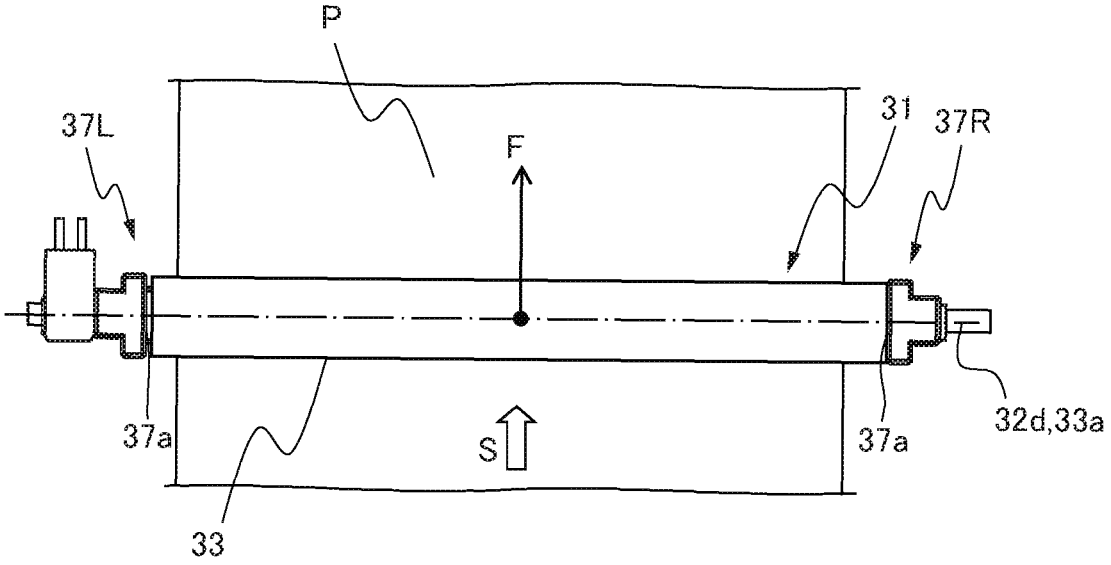
FIG. 10B is a diagram illustrating the position correction mechanism for the fixing film of the first embodiment and illustrating a misalignment-free state.

Next, with reference to FIGS. 10A and 10B, a mechanism for correcting the position of the fixing film 33 in the present embodiment will be described. FIGS. 10A and 10B illustrate the film assembly 31 and the pressure roller 32 viewed from the fixing film 33 side. Specifically, FIG. 10A illustrates a misalignment state, and FIG. 10B illustrates a misalignment-free state. When a misalignment occurs between the pressure roller 32 and the fixing film 33, the fixing film 33 moves rightward or leftward in the width direction. FIG. 10A illustrates a state where the misalignment causes an axis 33*a* of the fixing film 33 to be oblique with respect to an axis 32*d* of the pressure roller 32. In FIG. 10A, a portion of the fixing film 33 on the film holder 37L side is moved upstream in the conveyance direction S of the sheet P and oblique with respect to the pressure roller 32, and a portion of the fixing film 33 on the film holder 37R side is moved downstream in the conveyance direction S of the sheet P and oblique with respect to the pressure roller 32. Note that in FIG. 10A, the pressure roller 32 that overlaps with the sheet P and the fixing film 33 is indicated by a broken line.

As illustrated in FIG. 10A, the fixing film 33 is applied with a force F by the rotation of the pressure roller 32. The direction of the force F is not necessarily parallel to the conveyance direction S of the sheet P. If the direction of the force F is not parallel to the conveyance direction S of the sheet P, the force F is decomposed into a force F1 applied in a direction parallel to the axis 33*a* of the fixing film 33, and a force F2 applied in a direction perpendicular to the direction of the force F1. Thus, the fixing film 33 is moved toward the film holder 37R, that is, in the second direction by the force F1.

As described with reference to FIGS. 9A and 9B, in the film holder 37R, if the regulation member 37*a* is pressed by the fixing film 33, the regulation member 37*a* moves upstream in the sheet conveyance direction S. Specifically, when the regulation member 37*a* moves, the inner circumferential surface 33*i* of the fixing film 33 slides on the inner-portion abutment surface 65 of the regulation member 37*a*, so that the regulation member 37*a* is applied with a force that moves the regulation member 37*a* upstream in the sheet conveyance direction S. As a result, as illustrated in FIG. 10B, the portion of the fixing film 33 on the film holder 37R side is applied with a force that move the portion of the fixing film 33 upstream in the sheet conveyance direction S. With this operation, the fixing film 33 is turned by the force, and the misalignment between the pressure roller 32 and the fixing film 33 is canceled.

In FIG. 10B, the misalignment is canceled in a state where the axis 32*d* of the pressure roller 32 completely overlaps with the axis 33*a* of the fixing film 33. However, the misalignment may be canceled in another state other than the above-described state. For example, the misalignment may be canceled when the position of the fixing film 33 relative to the pressure roller 32 becomes a suitable position positioned for fixing a toner image to a sheet. If the misalignment is canceled, the angle between the force F and the axis 33*a* of the fixing film 33 changes. If the angle between the force F and the axis 33*a* of the fixing film 33 changes, the force F1 decreases, decreasing the force of the end portion of the fixing film 33 that presses the regulation member 37*a*. As a result, the one end portion of the fixing film 33 is separated from the regulation member 37*a*. As a result, the regulation member 37*a* is applied with a force that moves the regulation member 37*a* downstream in the sheet conveyance direction S, and the regulation member 37*a* moves from the position illustrated in FIG. 9B back to the position illustrated in FIG. 9A. Thus, the present embodiment reduces the force of one end portion of the fixing film 33 that presses the regulation member 37*a*, and thereby prevents the wear of the fixing film 33.

Configuration of Guide Unit

Referring back to FIG. 1, a configuration to guide the sheet that has passed through the nip portion N, downstream in the sheet conveyance direction S will be described. The fixing film 33 is rotated in a direction indicated by an arrow A of FIG. 1, by the rotation of the pressure roller 32 that rotates in a direction indicated by an arrow B of FIG. 1. In this state, the inner-portion abutment surface 65 (see FIG. 4) of the regulation member 37*a* is held such that the inner-portion abutment surface 65 is in contact with the inner circumferential surface 33*i* of the fixing film 33. Thus, since the fixing film 33 rotates along the shape of the inner-portion abutment surface 65, a portion of the fixing film 33 that is in contact with the inner-portion abutment surface 65 is hardly deformed or displaced. That is, the fixing film 33 is regulated by the inner-portion abutment surface 65 of the regulation member 37*a* so that the circular trajectory of the fixing film 33 is kept. Thus, the sheet is conveyed while nipped in the nip portion N in a state where the circular trajectory of the fixing film 33 is kept by the regulation member 37*a*.

The downstream edge of the sheet nipped in the nip portion N is separated from the fixing film 33 at a position positioned downstream from the nip portion N in the sheet conveyance direction S. For easily separating the downstream edge of the sheet from the fixing film 33, a portion of the fixing film 33 located downstream from the nip portion N in the conveyance direction S has a less curvature radius for making a tight curve of the fixing film 33. In the present embodiment, the portion of the fixing film 33 that has the less curvature radius is hereinafter referred to as a sheet separation portion D. The sheet separation portion D formed in this manner increases sheet separation performance required when the sheet is separated from the fixing film 33 when passing through the fixing apparatus 20. However, if the curvature radius of the sheet separation portion D is too small, the change in bend of the fixing film 33 increases when the fixing film 33 is rotated. As a result, the bend of the fixing film 33 may accelerate the deterioration of the fixing film 33. For this reason, the sheet separation portion D is designed so as to have a curvature radius that keeps the sheet separation performance (required when the sheet is separated from the fixing film 33 when passing through the fixing apparatus 20) and that prevents the deterioration of the fixing film 33 caused by the change in bend of the fixing film 33.

However, if the position of the nip portion N changes, the sheet separation performance required when the sheet is separated from the fixing film 33 in the fixing apparatus 20 may be insufficient. The change in position of the nip portion N is caused by various factors including a continuous printing in which a variety of sheets with different materials and thicknesses is used, an environmental condition of an installation site of the image forming apparatus 100, and a misalignment caused by the deterioration of the pressure roller 32. In the present embodiment, however, a guide unit 45 is disposed for guiding the sheet downstream from the fixing film 33. The guide unit 45 is disposed in the vicinity of the fixing film 33 and positioned downstream from the fixing film 33 in the sheet conveyance direction S. Specifically, the guide unit 45 is separated from the fixing film 33 by a predetermined clearance X. The clearance X between the fixing film 33 and the guide unit 45 is the shortest distance between the guide unit 45 and the sheet separation portion D of the fixing film 33. If the clearance X between the sheet separation portion D of the outer circumferential surface 33*c* of the fixing film 33 and the leading edge of the guide unit 45 is equal to or smaller than a predetermined distance, the sheet is separated from the fixing film 33 and guided downstream of the nip portion N. If the fixing film 33 is a metal sleeve, the clearance X between the sheet separation portion D and the guide unit 45 is preferably in a range from 0.3 to 2.0 mm. In the present embodiment, the clearance X between the sheet separation portion D and the guide unit 45 is 1.5 mm.

Figure 11:
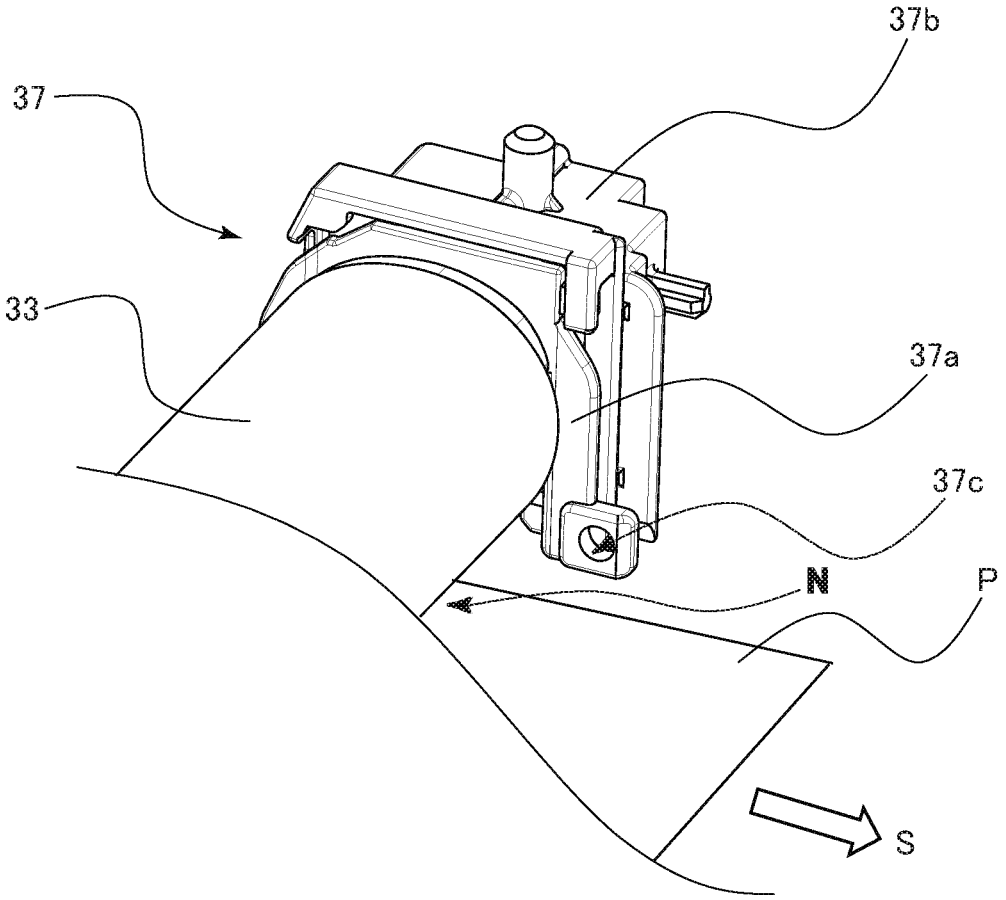
FIG. 11 is a perspective view of a film holder of the first embodiment.
Figure 12:
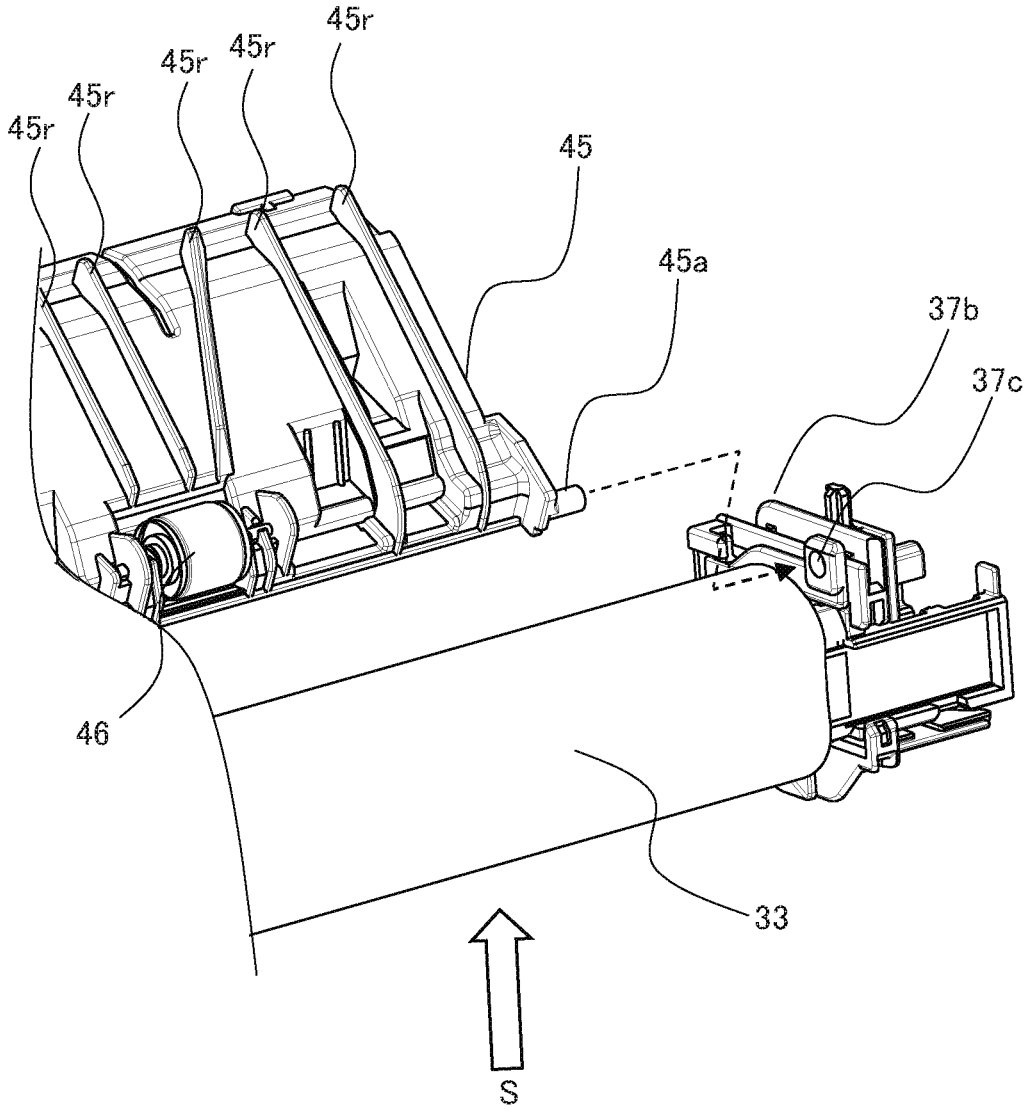
FIG. 12 is a diagram illustrating how a guide unit is attached to the film holder of the first embodiment.

By the way, if the clearance X between the sheet separation portion D and the guide unit 45 is too large when the fixing film 33 is rotated by the rotation of the pressure roller 32, the sheet may not be separated from the fixing film 33. On the other hand, if the clearance X between the sheet separation portion D and the guide unit 45 is too small, the guide unit 45 may contact the fixing film 33. In the present embodiment, as illustrated in FIGS. 11 and 12, a hole portion 37*c* that serves as an engaged portion of the present embodiment is formed in a side surface of the regulation member 37*a*. Note that the hole portion 37*c* may be formed in the end-portion abutment surface 61 of the regulation member 37*a*. FIG. 11 is a perspective view of the film holder 37, and FIG. 12 is a perspective view illustrating how the guide unit 45 is attached to the film holder 37. As illustrated in FIG. 11, the hole portion 37*c* is formed in the side surface of the regulation member 37*a*, disposed downstream from the nip portion N in the conveyance direction S of the sheet P. In addition, a rib 45*r* is formed on the guide Unit 45. The rib 45*r* is formed on convex shape, and reduced the contact area of the sheet P with the guide unit 45.

In addition, as illustrated in FIG. 12, a shaft portion 45*a* is formed on an end portion of the guide unit 45. Specifically, the shaft portion 45*a* is formed on one portion of the end portion, on the upstream side in the conveyance direction S. The shaft portion 45*a* serves as an engaging portion of the present embodiment, and engages with the hole portion 37*c*. Note that in FIG. 12, one end portion of the guide unit 45 is enlarged. Thus, the shaft portion 45*a* is formed on each end portion of the guide unit 45 (see FIGS. 13 to 15). An axis of the shaft portion 45*a* extends in a direction that is parallel to the axial direction of the flexible rotary member. Since the hole portion 37*c* and the shaft portion 45*a* engage with each other, the guide unit 45 is disposed at a position separated from the fixing film 33 by a clearance in the conveyance direction S of the sheet P. The hole portion 37*c* and the shaft portion 45*a* serve as an interlocking portion of the present embodiment. Note that the guide unit 45 may pivot on the shaft portion 45*a* so as not to contact the fixing film 33 and the pressure roller 32. The shaft portion may be formed on the regulation member 37*a*, and the hole portion may be formed in the guide unit 45 so as to engage with the shaft portion of the regulation member 37*a*.

Figure 13A:
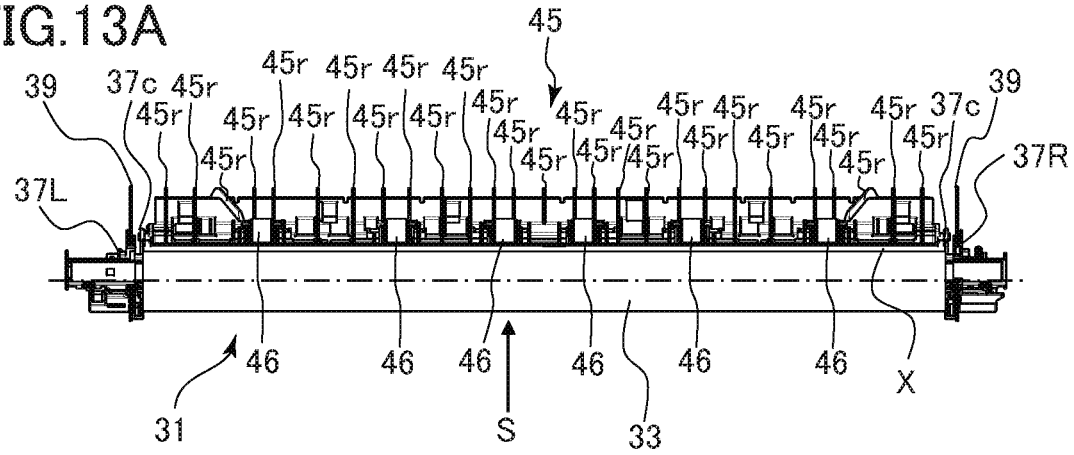
FIG. 13A is a diagram illustrating a film assembly and the guide unit of the first embodiment, separated from each other by a clearance X in a misalignment-free state.
Figure 13B:
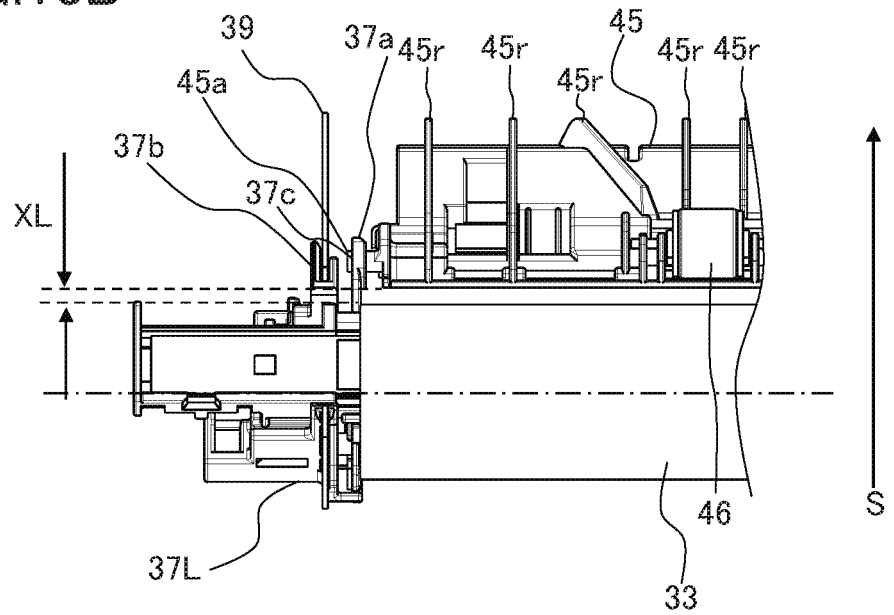
FIG. 13B is an enlarged view of a left film holder, in which the film assembly and the guide unit of the first embodiment are separated from each other by the clearance X in the misalignment-free state.
Figure 13C:
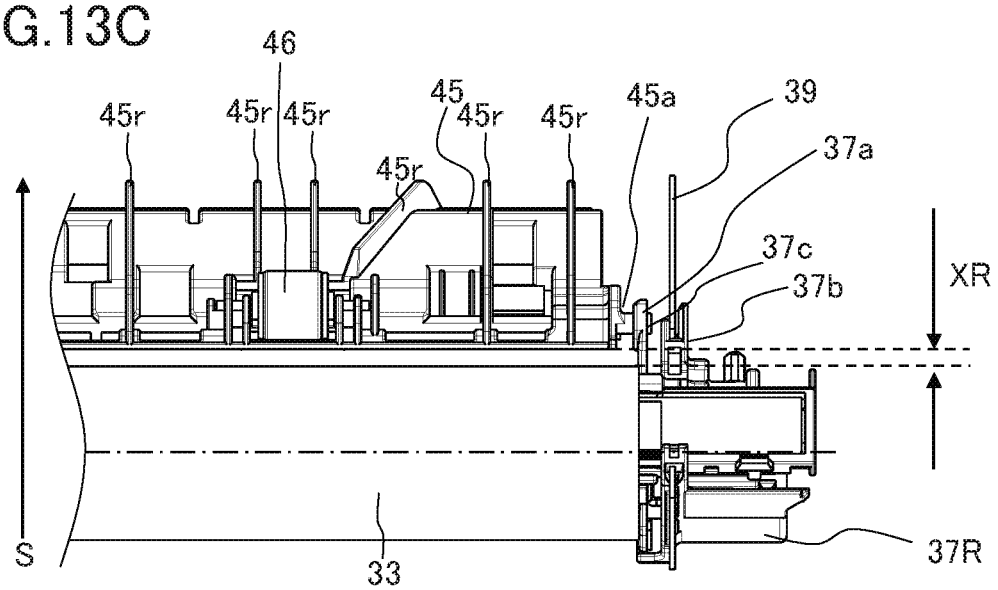
FIG. 13C is an enlarged view of a right film holder, in which the film assembly and the guide unit of the first embodiment are separated from each other by the clearance X in the misalignment-free state.
Figure 14A:
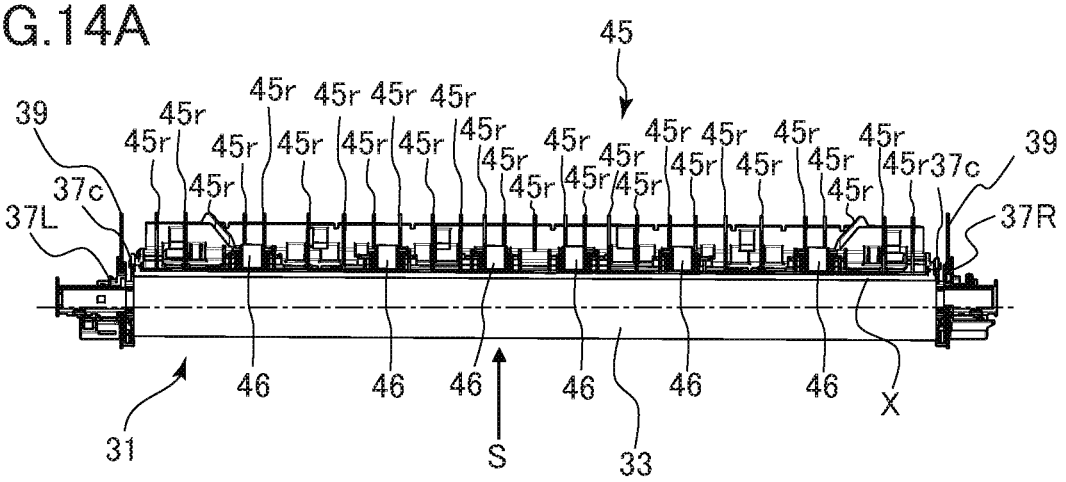
FIG. 14A is a diagram illustrating the film assembly and the guide unit of the first embodiment, separated from each other by the clearance X in a misalignment state.
Figure 14B:
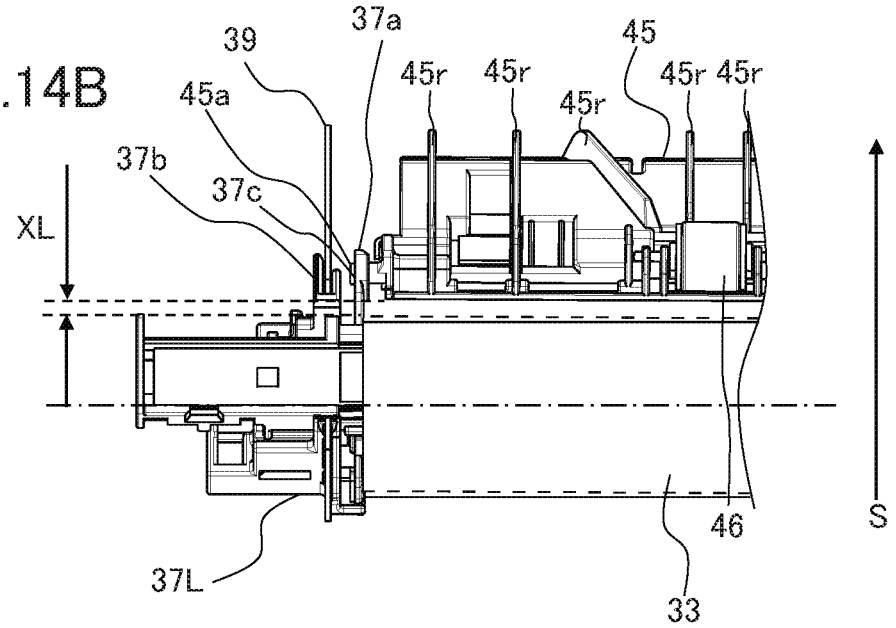
FIG. 14B is an enlarged view of the left film holder, in which the film assembly and the guide unit of the first embodiment are separated from each other by the clearance X in the misalignment state.
Figure 14C:
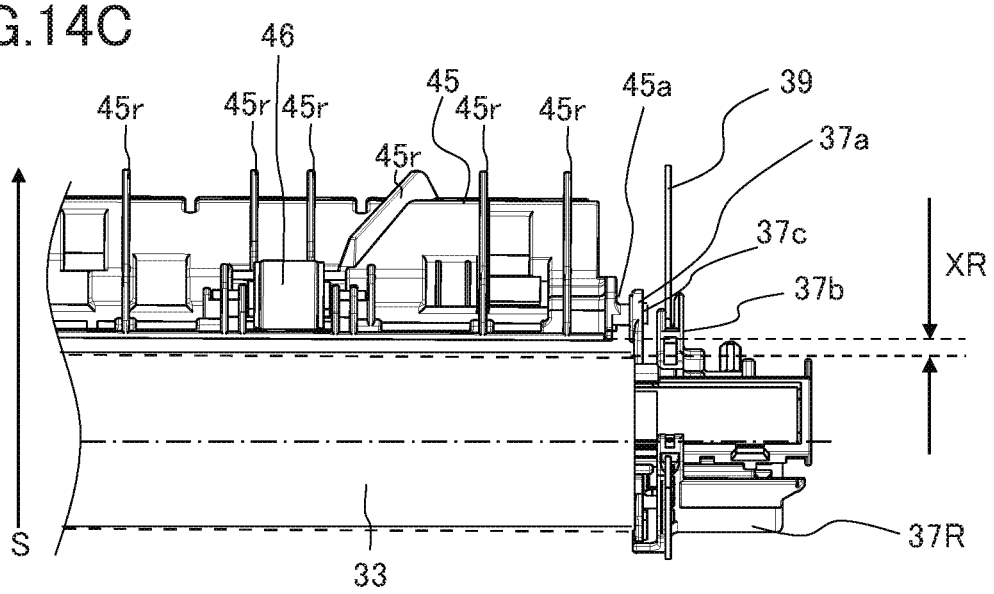
FIG. 14C is an enlarged view of the right film holder, in which the film assembly and the guide unit of the first embodiment are separated from each other by the clearance X in the misalignment state.
Figure 15A:
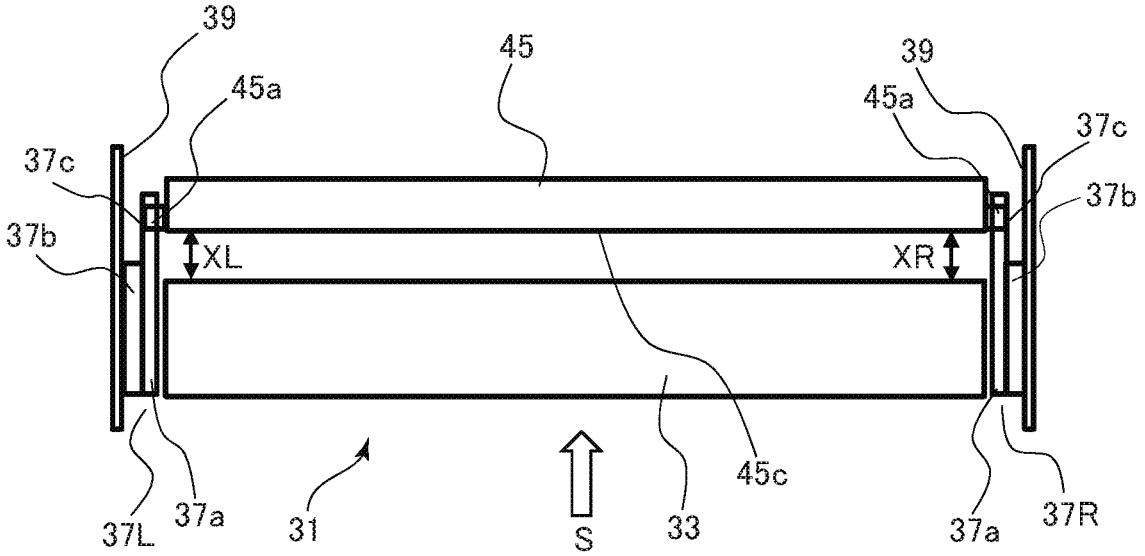
FIG. 15A is a schematic diagram illustrating arrangement of the film assembly and the guide unit of the first embodiment in a misalignment-free state.
Figure 15B:
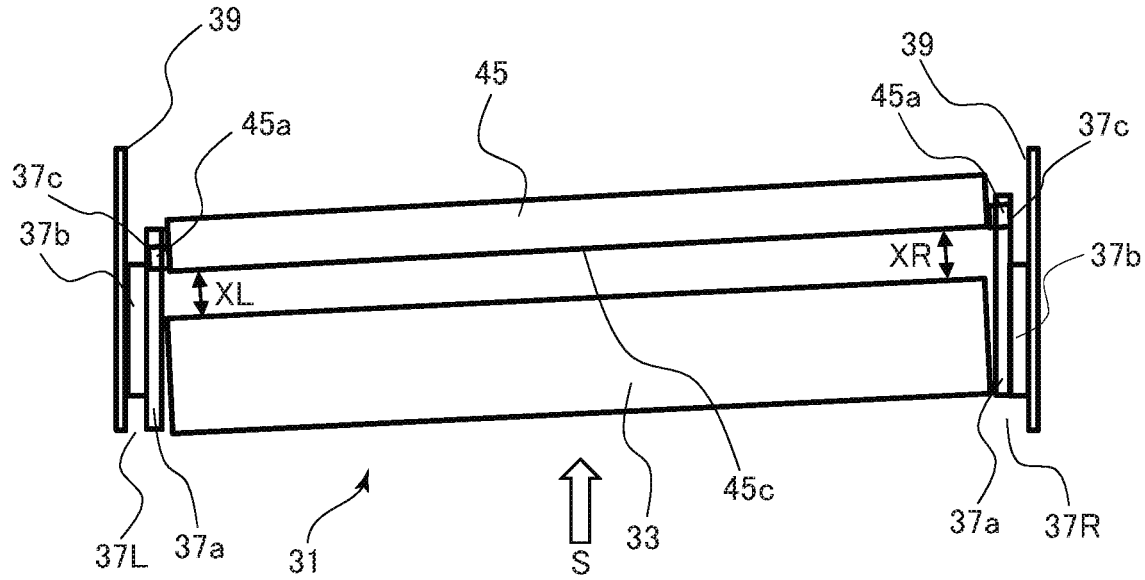
FIG. 15B is a schematic diagram illustrating the arrangement of the film assembly and the guide unit of the first embodiment in a misalignment state.

Next, with reference to FIGS. 13A to 15B, the clearance X between the sheet separation portion D and the guide unit 45 of the present embodiment will be described. FIGS. 13A to 14C illustrate the film assembly 31 and the guide unit 45 viewed from a direction from which a C direction of FIG. 1 extends. FIG. 13A illustrates the guide unit 45 and the fixing film 33 separated from each other by the clearance X by engaging the shaft portion 45*a* with the hole portion 37*c* in a misalignment-free state. FIG. 13B is an enlarged view of the film holder 37L of FIG. 13A. FIG. 13C is an enlarged view of the film holder 37R of FIG. 13A. FIG. 14A illustrates a state of the fixing film 33 displaced toward the film holder 37R in a misalignment state. FIG. 14B is an enlarged view of the film holder 37L of FIG. 14A. FIG. 14C is an enlarged view of the film holder 37R of FIG. 14A. FIG. 15A is a schematic diagram of the guide unit 45 and the fixing film 33 in the state illustrated in FIG. 13A and obtained before the misalignment occurs. FIG. 15B is a schematic diagram of the guide unit 45 and the fixing film 33 in the misalignment state illustrated in FIG. 14A.

As illustrated in FIG. 13A, since the hole portion 37*c* and the shaft portion 45*a* are engaged with each other, the guide unit 45 is separated from the fixing film 33 by the clearance X in the conveyance direction S of the sheet P. When viewed from a direction from which a C direction of FIG. 1 extends, the film holder 37L is disposed at one end portion of the fixing film 33 on the left side of the fixing film 33 in the axial direction. Since the shaft portion 45*a* is engaged with the hole portion 37*c* of the regulation member 37*a* of the film holder 37L, the guide unit 45 is separated from the fixing film 33 by a clearance XL in the conveyance direction S of the sheet P. The regulation member 37*a* of the film holder 37L is a first regulation member of the present embodiment. In addition, when viewed from a direction from which a C direction of FIG. 1 extends, the film holder 37R is disposed at the other end portion of the fixing film 33 on the right side of the fixing film 33 in the axial direction. Since the shaft portion 45*a* is engaged with the hole portion 37*c* of the regulation member 37*a* of the film holder 37R, the guide unit 45 is separated from the fixing film 33 by a clearance XR in the conveyance direction S of the sheet P. The regulation member 37*a* of the film holder 37R is a second regulation member of the present embodiment. Note that FIG. 13A illustrates the misalignment-free state. Thus, in the misalignment-free state, the clearance XL produced by the shaft portion 45*a* engaging with the hole portion 37*c* of the film holder 37L is equal to the clearance XR produced by the shaft portion 45*a* engaging with the hole portion 37*c* of the film holder 37R.

As illustrated in FIG. 14A, even in the misalignment state, since the hole portion 37*c* and the shaft portion 45*a* are engaged with each other, the guide unit 45 is separated from the fixing film 33 by the clearance X in the conveyance direction S of the sheet P. In this state, as indicated by a broken line of FIG. 14B, an end portion of the fixing film 33 on the film holder 37L side moves downstream in the sheet conveyance direction S due to the misalignment. However, at the end portion of the fixing film 33 located on the left side in the axial direction when viewed from a direction from which a C direction of FIG. 1 extends, the shaft portion 45*a* is engaged with the hole portion 37*c* of the film holder 37L. With this engagement, a portion of the guide unit 45 on the film holder 37L side is separated from the fixing film 33 by the clearance XL in the conveyance direction S of the sheet P. On the other hand, as indicated by a broken line of FIG. 14C, an end portion of the fixing film 33 on the film holder 37R side moves upstream in the sheet conveyance direction S due to the misalignment. However, at the end portion of the fixing film 33 located on the right side in the axial direction when viewed from a direction from which a C direction of FIG. 1 extends, the shaft portion 45*a* is engaged with the hole portion 37*c* of the film holder 37R. With this engagement, a portion of the guide unit 45 on the film holder 37R side is separated from the fixing film 33 by the clearance XR in the conveyance direction S of the sheet P.

As described with reference to FIGS. 10A and 10B, the fixing apparatus 20 of the present embodiment can correct the misalignment even when the fixing film 33 is oblique with respect to the axis 32*d* (see FIG. 10A) of the pressure roller 32. In the present embodiment, the regulation member 37*a*, which is moved in the sheet conveyance direction S by the movement of the fixing film 33, has the hole portion 37*c* engaged with the shaft portion 45*a* of the guide unit 45. In addition, the guide unit 45 is supported by the shaft portion 45*a* engaged with the hole portion 37*c*. Thus, if a misalignment occurs and the axis 33*a* of the fixing film 33 crosses the axis 32*d* of the pressure roller 32, the regulation member 37*a* moves in a state where the axis of the regulation member 37*a* also crosses the axis 32*d* of the pressure roller 32.

As illustrated in FIGS. 15A and 15B, the clearance X between the fixing film 33 and the guide unit 45 is set such that before and after the misalignment occurs, the clearance XL is kept between the guide unit 45 and the end portion of the fixing film 33 on the film holder 37L side and the clearance XR is kept between the guide unit 45 and the end portion of the fixing film 33 on the film holder 37R side. That is, before and after the misalignment occurs, and even in a state where the misalignment is being corrected, the engagement state between the hole portion 37*c* and the shaft portion 45*a* is unchanged. Thus, before and after the misalignment occurs, the clearance X is unchanged and kept constant. In the present embodiment, the clearance X is equal to the clearance XL and the clearance XR. Thus, the guide unit 45 moves together with the regulation member 37*a*, while disposed parallel with the fixing film 33. That is, before and after the misalignment occurs, and in a state where the misalignment is being corrected, the fixing film 33 and the guide unit 45 are separated from each other by the clearance X. In this state, the clearance X is kept between the whole of a longitudinal portion of the fixing film 33 and the guide unit 45 in the axial direction. Therefore, without affected by the change in the clearance X between the fixing film 33 and the guide unit 45, the sheet separation performance is kept constant before and after the misalignment occurs, and in a state where the misalignment is being corrected.

Thus, in the present embodiment, the guide unit 45 is separated from the fixing film 33 by the clearance (clearance X). In addition, the guide unit 45 can move together with the regulation member 37*a* in the conveyance direction S. Even when the guide unit 45 moves together with the regulation member 37*a* in the conveyance direction S, the clearance X is kept between the guide unit 45 and the fixing film 33. In such a configuration, since the guide unit 45 does not slide on the fixing film 33, the damage of the fixing film 33 can be prevented, and the failure in conveyance in the fixing apparatus 20 can be prevented. In addition, since the clearance X is a distance that allows the sheet to be easily separated from the fixing film 33, the failure in sheet separation can be prevented even when a positional displacement of the fixing film 33 is being corrected.

Second Embodiment

Next, a second embodiment of the present disclosure will be described. Since the configuration of the image forming apparatus 100 and the fixing apparatus 20 of the present embodiment is the same as that of the first embodiment, duplicated description thereof will be omitted. In the present embodiment, the image forming apparatus 100 or the fixing apparatus 20 includes a detection portion that changes an output value in accordance with the movement of the regulation member 37*a*, which is caused by the change in position of the nip portion N or the movement of the fixing film 33. In addition, an actuator 102 is driven to move the guide unit 45 in accordance with the output value from the detection portion. Thus, as in the first embodiment, the guide unit 45 is moved so as to be separated from the fixing film 33 by the clearance in the sheet conveyance direction. Specifically, before and after the misalignment occurs, and even in a state where the misalignment is being corrected, the guide unit 45 is moved such that the clearance XL and the clearance XR have a constant length.

Figure 17:
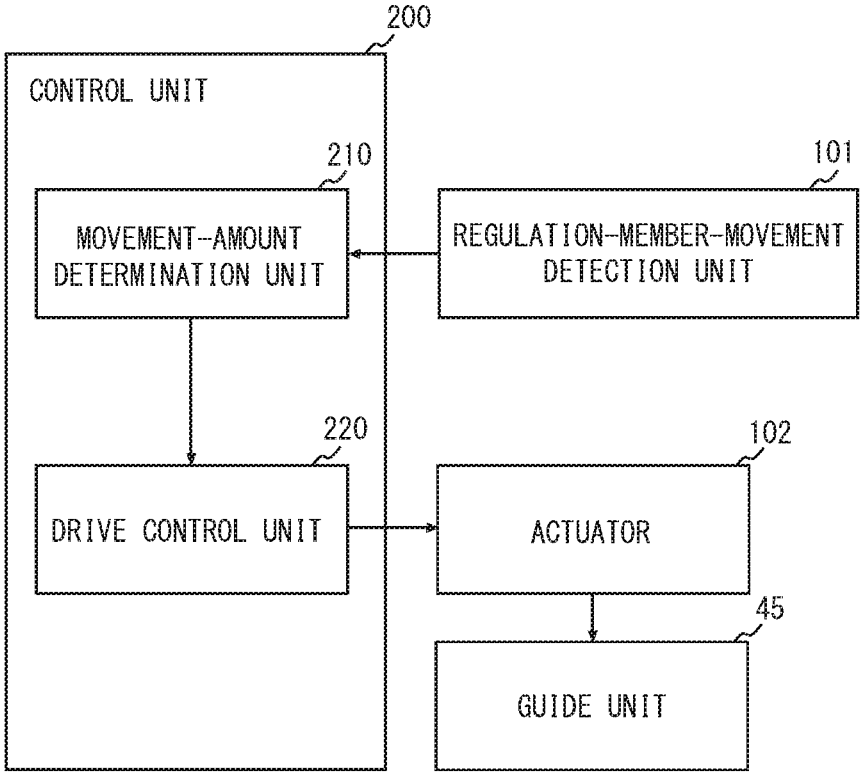
FIG. 17 is a control block diagram of a fixing apparatus of a second embodiment.

FIG. 17 is a block diagram illustrating a control system of the fixing apparatus 20 of the present embodiment. The control unit 200 controls operations of components of the fixing apparatus 20, and has hardware including a CPU (Central Processing Unit), a RAM (Random-Access Memory), a ROM (Read Only Memory), and an HDD (Hard Disk Drive). The CPU loads a control program for the fixing apparatus 20, which is stored in a storage medium such as the ROM or the HDD; and develops the control program in the RAM. Then the CPU performs computation depending on the control program, for achieving functions of the components of the control unit 200.

As illustrated in FIG. 17, the control unit 200 includes a movement-amount determination unit 210 and a drive control unit 220. The movement-amount determination unit 210 determines the amount of movement of the regulation member 37*a*, depending on the output value of a regulation-member-movement detection unit 101. The regulation-member-movement detection unit 101 is a sensor that changes its output value in accordance with the movement of the regulation member 37*a*, which is caused by the change in position of the nip portion N or the movement of the fixing film 33. The regulation-member-movement detection unit 101 serves as a detection portion of the present embodiment. The movement-amount determination unit 210 determines the amount of movement of the regulation member 37*a* in the sheet conveyance direction, depending on the output value of the regulation-member-movement detection unit 101. For example, the output value of the regulation-member-movement detection unit 101 changes in accordance with the amount of movement of the urging member 60 or the amount of movement of the end-portion abutment surface 61 in the axial direction of the fixing film 33. The regulation-member-movement detection unit 101 has only to be disposed at least one of the right end portion and the left end portion of the fixing film 33 in the axial direction. The movement-amount determination unit 210 then determines the amount of drive of the actuator 102, depending on the amount of movement of the regulation member 37*a* obtained from the output value of the regulation-member-movement detection unit 101; and sends data on the amount of drive of the actuator 102, to the drive control unit 220.

The drive control unit 220 drives the actuator 102 in accordance with the amount of drive of the actuator 102 determined by the movement-amount determination unit 210. The actuator 102 may be a solenoid or a motor, and may be disposed on the hole portion 37*c* or the shaft portion 45*a*. In such a configuration, the actuator 102 operates together with the hole portion 37*c* or the shaft portion 45*a*, as an interlocking portion of the present embodiment. When driven by the actuator 102, the guide unit 45 is moved to a position separated from the fixing film 33 by the clearance in the conveyance direction of the sheet P. As a result, the guide unit 45 is separated from the fixing film 33 by the clearance. Specifically, before and after the misalignment occurs, and even in a state where the misalignment is being corrected, the guide unit 45 is moved such that the clearance XL and the clearance XR have a constant length.

Figure 18:
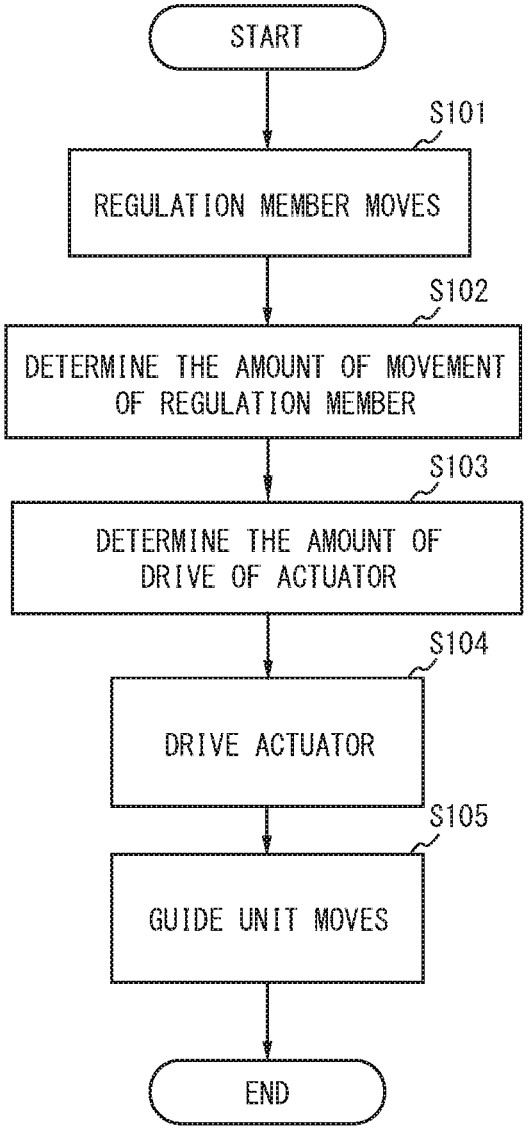
FIG. 18 is a flowchart illustrating a flow of operations for moving a guide unit of the second embodiment.

Next, a flow of operations that move the guide unit 45 in the present embodiment will be described with reference to FIG. 18. FIG. 18 is a flowchart illustrating the flow of operations that move the guide unit 45. Each step of FIG. 18 is executed by the control unit 200, or mainly by the movement-amount determination unit 210 and the drive control unit 220 that achieve internal functions of the control unit 200. If the regulation member 37*a* moves and an output value of the regulation-member-movement detection unit 101 is sent to the control unit 200 (S101), then the movement-amount determination unit 210 determines the amount of movement of the regulation member 37*a*, depending on the output value of the regulation-member-movement detection unit 101 (S102).

Then the movement-amount determination unit 210 determines the amount of drive of the actuator 102, depending on the amount of movement of the regulation member 37*a* determined in S102, for moving the guide unit 45 such that the clearance XL and the clearance XR has a constant length (S103). The drive control unit 220 drives the actuator 102 by the amount of drive of the actuator 102 determined in S103 (S104). By the actuator 102 driven in S104, the guide unit 45 is moved such that the clearance XL and the clearance XR has a constant length (S105). Thus, in the present embodiment, the movement of the guide unit 45 is controlled through the flow of operations described above, depending on the amount of movement of the regulation member 37*a*.

Thus, in the present embodiment, the guide unit 45 is moved in accordance with the amount of movement of the regulation member 37*a* in the conveyance direction S. In such a configuration, the guide unit 45 is separated from the fixing film 33 by the clearance (clearance X), and the clearance X is kept between the guide unit 45 and the fixing film 33 even when the guide unit 45 is moved together with the fixing film 33. In the present embodiment, as in the first embodiment, since the guide unit 45 does not slide on the fixing film 33, the damage of the fixing film 33 can be prevented, and the failure in conveyance in the fixing apparatus 20 can be prevented. In addition, since the clearance X is a distance that allows the sheet to be easily separated from the fixing film 33, the failure in sheet separation can be prevented even when a positional displacement of the fixing film 33 is being corrected.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-132608, filed Jul. 18, 2019, which is hereby incorporated by reference herein in its entirety.

What is claimed is:

1. A fixing apparatus comprising:

a side plate of the fixing apparatus;

a flexible rotary member having a cylindrical shape and configured to rotate in a state where an outer circumferential surface of the flexible rotary member is in contact with a sheet on which a toner image is formed;

a pressure roller configured to form a nip portion together with the flexible rotary member, the toner image being fixed to the sheet in the nip portion;

a heating element configured to heat the nip portion;

a regulation unit disposed at a position opposed to one end portion of the flexible rotary member in an axial direction of the flexible rotary member and configured to regulate movement of the flexible rotary member in the axial direction, the regulation unit including a movable member that is configured to move in a direction along a conveyance direction of the sheet by the one end portion of the flexible rotary member abutting on the movable member and a supporting member that is supported by the side plate to movably support the movable member;

a guide unit disposed downstream from the nip portion in the conveyance direction of the sheet and configured to guide the sheet that has passed through the nip portion; and an interlocking portion configured to move the guide unit in the conveyance direction in accordance with movement of the movable member in the conveyance direction so that a clearance is kept between the guide unit and the flexible rotary member in the conveyance direction, wherein the interlocking portion is provided on the movable member and the guide unit, wherein the interlocking portion includes a hole portion and a shaft portion that engages with the hole portion, and wherein an axis of the shaft portion is parallel to the axial direction of the flexible rotary member.

2. The fixing apparatus according to claim 1, further comprising:

an urging member disposed between the supporting member and the movable member and configured to urge the movable member in the axial direction.

3. The fixing apparatus according to claim 2, wherein the movable member comprises:

an inner-portion abutment surface on which an inner circumferential surface of the flexible rotary member slides, and an end-portion abutment surface against which the one end portion of the flexible rotary member abuts and which is pressed by the one end portion of the flexible rotary member in the axial direction, wherein the supporting member comprises a guide portion oblique with respect to the conveyance direction and the axial direction and configured to guide the movable member that moves in the axial direction, toward the conveyance direction, and wherein the movable member is guided and moved upstream in the conveyance direction by the guide portion.

4. The fixing apparatus according to claim 3, wherein the supporting member is configured to support the regulation movable member in a state where one portion of the movable member is accommodated by the supporting member, wherein the urging member is elastically deformed between the movable member, accommodated by the supporting member, and the supporting member in the axial direction, by the one end portion of the flexible rotary member pressing the end-portion abutment surface, and wherein the movable member is guided to the guide portion by the urging member being elastically deformed.

5. The fixing apparatus according to claim 1, wherein the guide unit comprises a roller configured to convey the sheet separated from the outer circumferential surface.

6. The fixing apparatus according to claim 1, wherein the interlocking portion is configured to keep a distance between the flexible rotary member and the guide unit in a range from 0.3 to 2.0 mm.

7. The fixing apparatus according to claim 1, further comprising a second regulation unit disposed at a position opposed to the other end portion of the flexible rotary member in the axial direction of the flexible rotary member and configured to regulate movement of the flexible rotary member in the axial direction, the second regulation unit including a second movable member configured to move in a direction along the conveyance direction of the sheet by the other end portion of the flexible rotary member abutting on the second movable member and a second supporting member supported by a second side plate of the fixing apparatus for movably supporting the second movable member.

8. An image forming apparatus comprising:

an electrophotographic image forming mechanism that forms a toner image on a sheet using an electrophotographic image forming process; and the fixing apparatus according to claim 1.

9. The fixing apparatus according to claim 1, wherein the heating element includes a substrate and a heat generating layer formed on the substrate, and wherein the heating element provided in an inner space of the flexible rotary member, and the nip portion is formed by the heating element and the pressure roller across the flexible rotary member.

10. A fixing apparatus comprising:

a side plate of the fixing apparatus;

a flexible rotary member having a cylindrical shape and configured to rotate in a state where an outer circumferential surface of the flexible rotary member is in contact with a sheet on which a toner image is formed;

a pressure roller configured to form a nip portion together with the flexible rotary member, the toner image being fixed to the sheet in the nip portion;

a heating element configured to heat the nip portion;

a regulation unit disposed at a position opposed to one end portion of the flexible rotary member in an axial direction of the flexible rotary member and configured to regulate movement of the flexible rotary member in the axial direction, the regulation unit including a movable member that is configured to move in a direction along a conveyance direction of the sheet by the one end portion of the flexible rotary member abutting on the movable member and a supporting member that is supported by the side plate to movably support the movable member; and a guide plate disposed downstream from the nip portion in the conveyance direction of the sheet and configured to guide the sheet that has passed through the nip portion, wherein the guide plate is movably supported on the movable member, and wherein the guide plate moves in the direction along the conveyance direction of the sheet with movement of the movable member.

11. The fixing apparatus according to claim 10, wherein the heating element includes a substrate and a heat generating layer formed on the substrate, and wherein the heating element provided in an inner space of the flexible rotary member, and the nip portion is formed by the heating element and the pressure roller across the flexible rotary member.

* * * * *